US010190841B2

(12) United States Patent
Laurence

(10) Patent No.: US 10,190,841 B2
(45) Date of Patent: Jan. 29, 2019

(54) FIXED AXLE COMPOUND CROSSBOW

(71) Applicant: AVAILABLE TECHNOLOGIES COMPANY INC., Bothell, WA (US)

(72) Inventor: Mark Laurence, Bothell, WA (US)

(73) Assignee: AVAILABLE TECHNOLOGIES COMPANY INC., Bothell, WA (US)

( * ) Notice: Subject to any disclaimer, the term of this patent is extended or adjusted under 35 U.S.C. 154(b) by 0 days.

(21) Appl. No.: 15/816,904

(22) Filed: Nov. 17, 2017

(65) Prior Publication Data

US 2018/0156564 A1 Jun. 7, 2018

Related U.S. Application Data

(60) Provisional application No. 62/423,922, filed on Nov. 18, 2016.

(51) Int. Cl.
*F41B 5/12* (2006.01)

(52) U.S. Cl.
CPC ..... *F41B 5/123* (2013.01)

(58) Field of Classification Search
CPC ..... F42B 5/12; F42B 5/123; F42B 5/0094; F42B 5/10; F42B 5/105
USPC ..... 124/25, 25.6
See application file for complete search history.

(56) References Cited

U.S. PATENT DOCUMENTS 3,851,638 A * 12/1974 Alexander ..... F41B 5/10 124/25.6
4,169,456 A * 10/1979 Van House ..... F41B 5/12 124/25
4,458,657 A * 7/1984 Stockmar ..... F41B 5/0094 124/17
4,512,326 A * 4/1985 Jarrett ..... F41B 5/10 124/25.6
4,686,955 A * 8/1987 Larson ..... F41B 5/10 124/25.6
4,879,987 A * 11/1989 Nishioka ..... F41B 5/123 124/25
4,926,832 A * 5/1990 Darlington ..... F41B 5/10 124/23.1
4,986,250 A * 1/1991 Darlington ..... F41B 5/10 124/25.6
5,301,651 A * 4/1994 LaBorde ..... F41B 5/10 124/23.1
5,535,727 A * 7/1996 Helmuth ..... F41B 5/10 124/25.6
5,638,804 A * 6/1997 Remick ..... F41B 5/10 124/25.6
5,791,322 A * 8/1998 McPherson ..... F41B 5/10 124/25.6
6,155,243 A * 12/2000 Gallops, Jr. ..... F41B 5/105 124/25

(Continued)

*Primary Examiner* — Alexander Niconovich
(74) *Attorney, Agent, or Firm* — Christopher A. Wiklof; Nicholas S. Bromer; Launchpad IP, Inc.

(57) ABSTRACT

A crossbow includes two rotatable cam assemblies mounted on a rigid cam support structure, the rotation axes of which are fixed relative to and arranged at a forward end of a stock. Limbs are coupled to the stock at positions rearward from the front of the stock. The limbs couple to the cam assemblies via power cables arranged generally parallel to the stock. The cam assemblies provide travel distance multiplication to a bowstring relative to the travel distance of the limb tips.

23 Claims, 3 Drawing Sheets

(56) References Cited

U.S. PATENT DOCUMENTS

| | | | | |
|---|---|---|---|---|
| 7,363,921 | B2 * | 4/2008 | Kempf | F41B 5/105 124/25 |
| 7,823,572 | B2 * | 11/2010 | Anderson | F41B 5/123 124/25 |
| 7,891,348 | B2 * | 2/2011 | Colley | F41B 5/123 124/25 |
| 8,387,603 | B2 * | 3/2013 | Darlington | F41B 5/10 124/23.1 |
| 9,297,604 | B1 * | 3/2016 | Sidebottom | F41B 5/123 |
| 9,453,698 | B1 * | 9/2016 | Grace | F41B 5/1411 |
| 2007/0101980 | A1 * | 5/2007 | Sims | F41B 5/10 124/25.6 |
| 2014/0190460 | A1 * | 7/2014 | Langley | F41B 5/105 124/25.6 |
| 2014/0360480 | A1 * | 12/2014 | Koch | F41B 5/10 124/25.6 |

* cited by examiner

FIXED AXLE COMPOUND CROSSBOW

CROSS-REFERENCE TO RELATED APPLICATIONS

The present application claims priority benefit from U.S. Provisional Patent Application No. 62/423,922, entitled "FIXED-AXIS AXLE CROSSBOWS," filed Nov. 18, 2016; which, to the extent not inconsistent with the disclosure herein, is incorporated by reference.

BACKGROUND

Previous workers in the crossbow art have used mechanical arrangements that allow the parts to work imprecisely, by using excessive parts that create excessive play. Play in any mechanism may reduce precision of location, and in a crossbow, mechanical play reduces precision of aiming.

One notable problem in the prior art is the use of movable cams and wheels located at the ends of movable parts, notably at the ends of the resilient limbs that store the energy used for shooting the arrow or bolt. A cam or wheel at the end of a limb moves during release of an arrow, and this is not conducive to precise aiming. Movement of the cam or wheel causes lateral acceleration of the tensile member engaging the cam or wheel, which causes addition imprecision and extra bearing friction. Moreover, friction in the cam or wheel bearing, if not precisely matched by that of the one on the other side of the crossbow, will throw off the aim, and precise matching the friction exactly is difficult. The same is true of any difference in spring constant, length, etc. between the two limbs (bow arms). Such differences will cause deflection of the arrow trajectory during the launch.

SUMMARY

According to an embodiment, a compound crossbow includes a stock assembly having a front end, back end, left, right, top, and bottom sides; left and right flexible limbs extending laterally respectively from the left and right sides of the stock assembly to respective limb tips; and a rigid cam support structure disposed at or near the front end of the stock assembly. Left and right cam assemblies are rotationally coupled to the rigid cam support structure on axles such that rotational axes of the left and right cam assemblies are fixed relative to the stock assembly. A synchronizing cable is operatively coupled to the left and right cam assemblies to cause the left and right cam assemblies to counter rotate synchronously. Left and right power cables are operatively coupled respectively between the left and right limbs and the left and right cam assemblies and a bowstring is operatively coupled to the left and right cam assemblies.

According to an embodiment, a crossbow includes a stock assembly defining an arrow track configured to be in contact with an arrow prior to release, the stock assembly having a front end and a back end, the stock assembly being characterized by a length L between the front end and back end. Left and right flexible limbs extend laterally from the stock assembly respectively to a left limb tip and a right limb tip. A left cam assembly and a mirror-image right cam assembly are each rotatably mounted on a respective end of a rigid cam support structure. Each one of the left and right cam assemblies includes a respective bowstring cam, a synchronizing wheel, and a power cable cam. The rigid cam support structure is disposed adjacent and perpendicular to the front end of the stock assembly and fixed rigidly thereto. The cam support structure can be disposed in a plane defined by the stock assembly and the first and second limbs or in a plane parallel thereto and extending left and right from the centerline of the stock. A left bearing and a right are disposed in the cam support structure, configured to rotatably support the left and right cam assemblies on respective fixed axes of rotation. A left limb cable and a right limb cable are attached respectively to the left limb tip and the right limb tip without any intervening wheel or cam, the left limb cable being attached to the left limb-cable cam, and the right limb cable being attached to the right limb-cable cam. A synchronizing cable is disposed between the left synchronizing wheel and the right synchronizing wheel, and configured to cross itself in a central medial portion. A bowstring extends between the left bowstring cam or wheel and the right bowstring cam or wheel, the bowstring being anchored to both. The bowstring, limb cables, and synchronizing cable are arranged so as to exert force only on an outer circumferential portion of any cam or wheel. The synchronizing cable extends freely in space between the left and right cam/wheel units. Force is exerted between any cable or string and any other cable or string only by way of axial torque exerted by the cam/wheel units.

According to an embodiment, for a crossbow including a trigger actuating a bowstring hold-and-release mechanism to release a bowstring after the crossbow has been cocked, and a stock, the stock further including a projectile track, a method of stiffening the stock of the crossbow includes deploying a strut substantially parallel to the stock and at distance below the stock and fastening the stock to the strut to the stock at selected places along the length of the stock with fasteners.

According to embodiments, a compound crossbow achieves rigidity and low mechanical play for precision arrow flight.

According to an embodiment, in a compound crossbow, all cams, wheels, and other rotating parts are rigid and fixed, except for their ability to rotate. None of the rotating parts are translatable, nor do their axes of rotation change direction.

According to another embodiment, in a compound crossbow, the rotating parts are rotatably coupled to a rigid cam support structure, which in turn is rigidly coupled to the front end of the stock. This creates a framework with minimal play or looseness. In an embodiment, braces or trusses prevent the cam support structure from rotating relative to the stock, especially in the horizontal plane that is parallel to the bowstring and the stock.

The cam support structure can be made additionally rigid, in relation to the stock, by connecting these two frame parts with tensile stays, braces, trusses, etc.

According to an embodiment, a compound crossbow keeps arrow fletches or vanes out of contact with other parts of the crossbow, especially tensile members such as the bowstring and limb cables. An arrow is fletched with vanes to keep it flying straight. Typically, the vanes protrude farther from the arrow shaft in the case of hunting arrows as compared to target arrows. If the vanes hit any part of the crossbow, including a limb cable or a figure-8 synchronizing cable, the arrow or bolt will be deflected somewhat.

In an embodiment, a strut may be disposed above or below the stock on which the bolt slides. The strut may be, along with the stock, part of the crossbow frame. The strut can have a similar layout as the stock and its rigid cam support structure. The strut can include a second bearing for each cam/wheel axle.

In an embodiment, a synchronizing cable extends between left and right cam/wheel units.

DETAILED DESCRIPTION

Figure 1A:
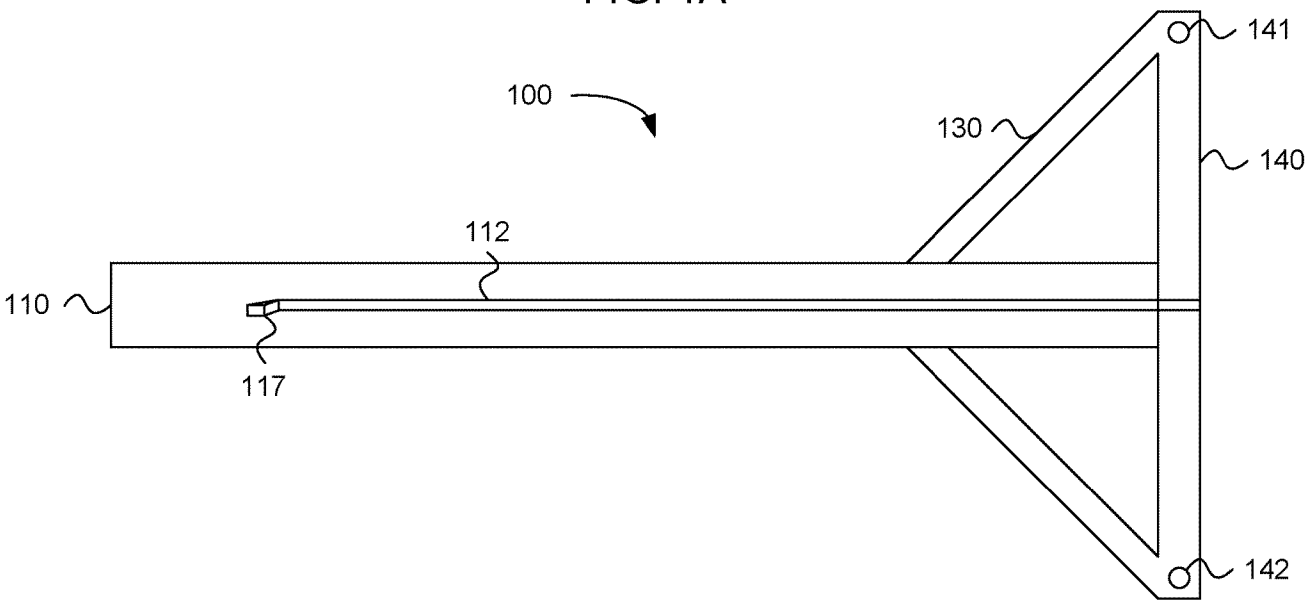
FIG. 1A is a plan view of a crossbow stock, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

As used herein, the terms bolt and arrow are used interchangeably and are considered synonymous. As used herein the terms limb cable and power cable are used interchangeably and are considered synonymous, referring to a cable that couples a limb or other spring device to a cam assembly.

A compound crossbow includes fixed axles and bearings configured to support cams. The fixed axles are coupled by a synchronization mechanism configured to equalize motion between the cams. According to embodiments, the bearings, axles, and cams are disposed at or near a front end of a crossbow stock to maximize length of travel of the crossbow string while in contact with the knock of the arrow.

An object of embodiments is perfect horizontal and vertical nock travel, which requires a rigid crossbow structure. Rigidity, in the stock especially, is important for the following reason: at rest, during the draw stroke and at full draw, tensions in the bowstring and other tensile members are exerted between points that are offset from the centerline of the stock, which tends to bend the stock; when the bolt is shot, these bending forces dissipate, changing the bending moment on the stock during the launch of the bolt, and causing it to change shape as the bowstring and other tensile members relax. Thus, the stock will change shape during discharge of the arrow, the direction of the bolt will change, and the aim of the shot will be thrown off. The shot can also be thrown off by looseness between parts.

FIG. 1A is a simplified depiction of a crossbow assembly 100, according to an embodiment. The crossbow assembly includes a stock 110, a cam support 140, and a truss 130, all of which are fastened together or made as a unit so as to achieve a high rigidity. According to embodiments, a separate truss 130 may be omitted if the cam support 140 is sufficiently stiff. The illustrated left and right trusses 130 triangulate the frame and increase the resistance to relative rotations of the stock 110 and the cam support 140. The trusses 130 are optional and may have different forms, such as triangulated beams, tensile members, etc.

The cam support 140 may define bearing holes 141 and 142 on the left and right sides respectively, which accept optional bearings (see 180, 182 in FIG. 3) and axles and support the axles against translational and inclination movements, as discussed below.

The stock 110 defines an arrow guide or projectile track 112, which may be of conventional design, and a space 117 that can accept a bowstring hold-and-release mechanism (not shown in FIG. 1A), which may also be of conventional design.

Figure 1B:
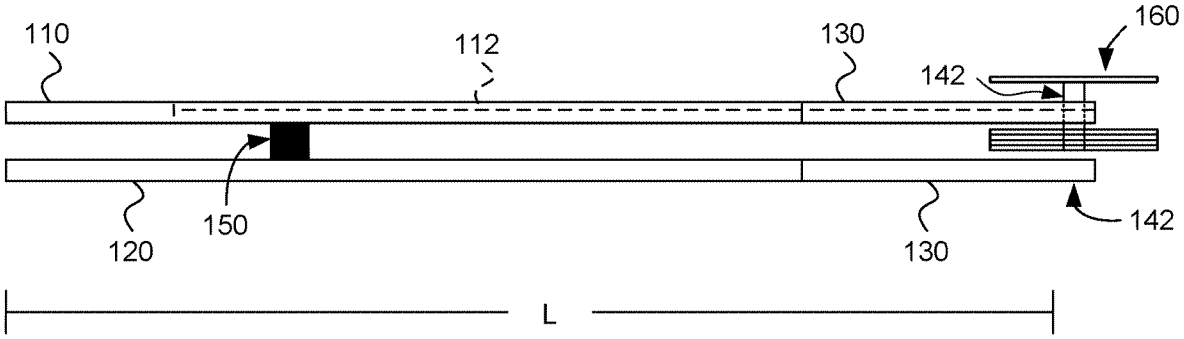
FIG. 1B is a side view of the crossbow stock with cams, according to an embodiment.

FIG. 1B is a side view of the embodiment of FIG. 1A, with additional elements shown: a strut 120, a limb 150, and a cam assembly 160.

The strut 120 may parallel the stock 110 over at least a part of the length L of the stock 110, and if fastened to the stock 110 in selected locations, will greatly stiffen the stock 110 against bending. One place where the stock 110 and strut 120 may be fastened together is around the limb 150, to which both may be fastened (limb 150 is depicted in cross section in FIG. 1B). The strut 120 and stock 110 may be fastened at other places to stiffen the frame, and in general the more places they are fastened the stiffer the structure will be. According to an embodiment, the entire space between the stock 110 and the strut 120 may be filled with a layer of crush-resistant material (not shown) adhered to the stock 110 and strut 120 to create a "stressed-skin" structure.

Figure 3:
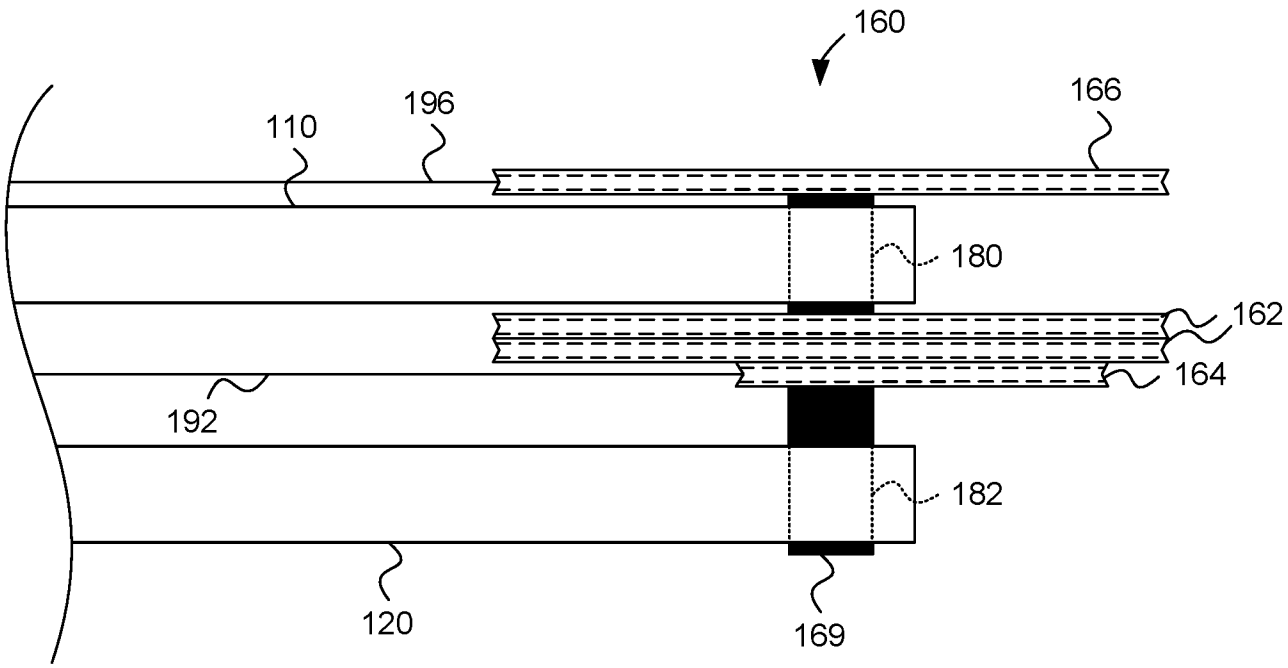
FIG. 3 is a detailed elevational view of the crossbow of FIGS. 2A and 2B, according to an embodiment.

On the right side of FIG. 1B is shown a cam assembly 160, which is illustrated in detail in FIG. 3.

Figure 2A:
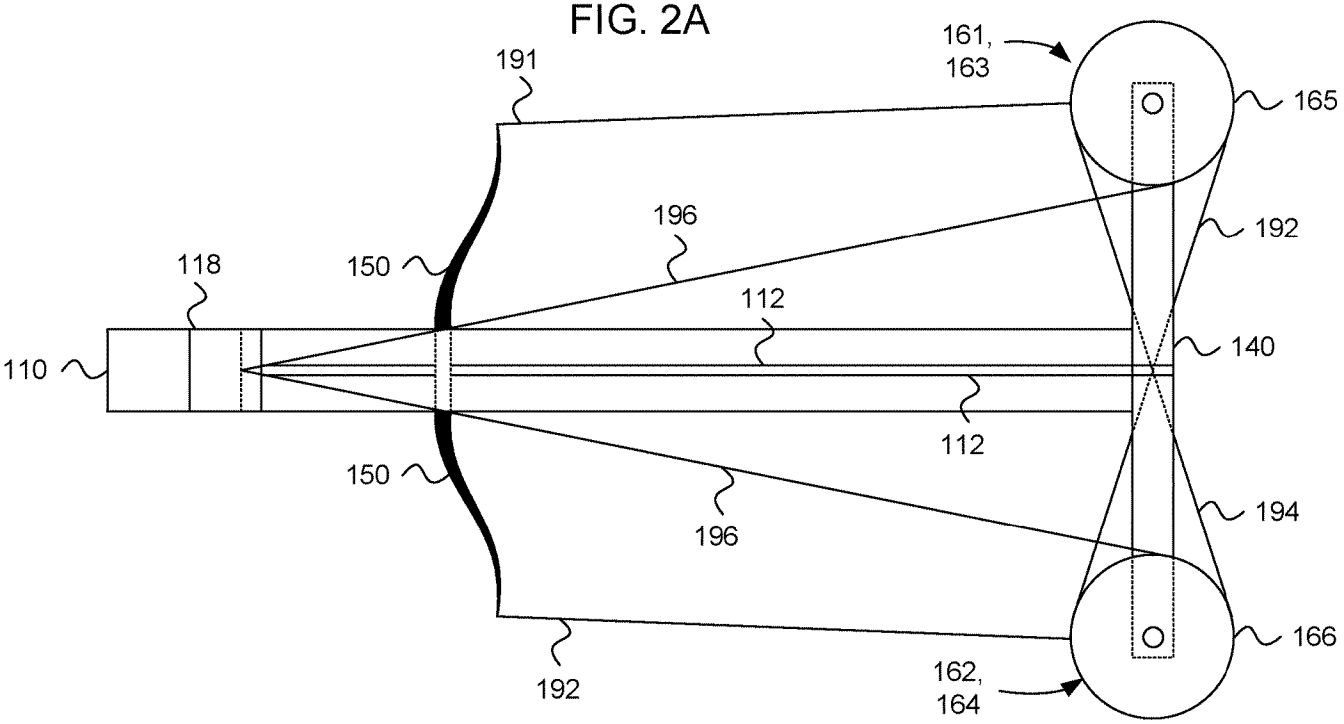
FIG. 2A is a plan view of a crossbow, according to an embodiment.
Figure 2B:
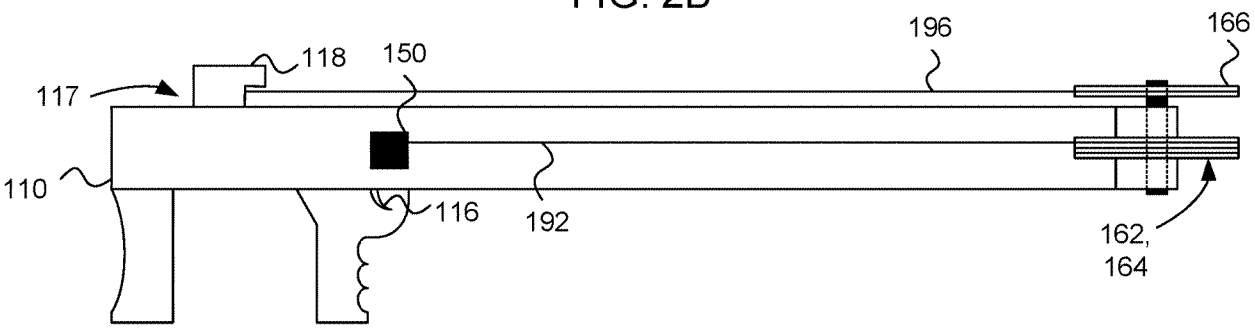
FIG. 2B is a side view of the crossbow of FIG. 2A, according to an embodiment.

FIGS. 2A and 2B are plan and elevation views of a crossbow including the frame of FIG. 1A, and showing the limbs 150. The tips of the illustrated limbs 150, which are resilient and bendable, are attached to respective left and right power cables 191 and 192, for example by direct attachment or by way of a rotatable pin, eye, etc. The power cables do not exert any substantial rotational moment on the ends of the limbs 150, and convey only tension force. The distal end of the left power cable 191 is wrapped around the outer circumference of a left power cable cam 163 (obscured in FIG. 2A), and the right power cable 192 is wrapped around outer circumference of a right power cable cam 162. (obscured FIG. 2A). FIG. 3 provides a better elevation view of the right cam assembly 160.

In FIGS. 2A and 2B, the space 117 houses a bowstring hold-and-release mechanism 118 which is actuated by a trigger 116. Pulling the trigger 116 releases a bowstring 196 and an arrow (not shown). The bowstring 196 is wrapped around bowstring wheels 165, 166, which are the uppermost cam or wheel on the cam units 160; although shown as wheels (circular, round, or arc-segment cams), they can comprise cams of any shape needed to adjust the force function.

A synchronizing cable 194, seen in FIG. 2A, is wrapped around in figure-8 configuration around the circumference of a synchronizing wheel or wheels 162, as seen in FIG. 3 (left-hand synchronizing wheel(s) 161 is behind wheel 162 in FIG. 3). This arrangement reduces any unevenness in the forces or motions of the two sides of the crossbow.

FIG. 3 also illustrates an upper bearing 180 and a lower bearing 182, mounted respectively in the stock 110 and the strut 120, which hold the axle 169 of the cam unit 160 on either side. The strut 120 and the lower bearing 182 are optional. According to many embodiments, the cam units 160 are supported on a single bearing 180. The bearing(s) 180, 182 can be of various types, including simple holes in the frame, but should be precise enough to prevent the axis of the cam unit 160 from changing direction relative to the frame. According to embodiments, the bearings 180, 182 are bronze, sintered, and/or polymer, such as polytetrafluoroethylene. The strut bearing 182 can further immobilize the rotation axis of each cam unit axle, as compared to the use of just an upper bearing, which will more firmly fix the axes of the cam units 160.

In the illustrated embodiments, the strut 120 is on the lower side of the stock 110, leaving the upper side of the stock 110 open for emplacing an arrow (not shown) in the arrow guide 112. Alternatively, the strut 120 can be placed above the stock 110, with a slot or other arrangement to permit an arrow to be placed into arrow guide 112 from above. Furthermore, the limbs can be doubled (with one strut above the stock and another below) if double cams are used to transmit the limb forces; this would result in a more symmetrical frame and could lead to reduced bending.

Whether one strut is used, or two or more, an external strut will increase the stiffness of the frame and resist any bending of the stock which would throw off the aim. Considering a cross section of the frame taken perpendicular to the arrow, the stock itself will have a certain moment of inertia, I (a measure of resistance to bending, or stiffness), which is proportional to the square of the thickness of the stock. If a strut is added the stock effectively becomes thicker, the moment of inertia is greatly increased because of the factor of the square of the thickness; this is true even if the strut is fastened to the stock only at certain points, such as near the ends. (If there were no connection between the two, the stiffness of the stock would not be increased at all.)

The structure on the left and right sides of a center plane can be symmetrical and the motions synchronized, so that any forces tending to bend the stock left or right are incidental. In contrast, the forces exerted on the stock that tend to bend it in the vertical plane are generally not as symmetrical.

In an embodiment, the limb or limbs 150 are fastened between the stock 110 and a strut 120, and can act as one stiffener connecting the stock to the lower strut. As noted above, such connections make the stock stiffer in the vertical direction.

If the limb or limbs 150 are centered between the stock and a strut, and so are the limb cables 191, 192, and the limb cables are symmetrical in the vertical direction (illustrated in FIG. 3), then the force transmitted from the limbs by the limb cables will be exerted along a line halfway between the stock and the strut, assuming that the cams to which they attach are also centered. If so, then the limb cables will not exert any bending force on the combination of the stock and strut. The height of the cables 191, 192 can alternatively be adjusted downward to compensate for the tension in the bowstring 196, and by proper design known to those skilled in the mechanical arts, can result in a negligible bending force on the strut 120.

Referring to FIGS. 1A, 1B, 2A, 2B, and 3, according to an embodiment a compound crossbow includes a stock assembly 110 having a front end, back end, left, right, top, and bottom sides. Left and right flexible limbs 150 extend laterally respectively from the left and right sides of the stock assembly 110 to respective limb tips. A rigid cam support structure 140 is disposed at or near the front end of the stock assembly 110. Left and right cam assemblies 160 are rotationally coupled to the rigid cam support structure 140 such that rotational axes of the left and right cam assemblies 160 are fixed relative to the stock assembly 110. A synchronizing cable 194 is operatively coupled to the left and right cam assemblies 160 to cause the left and right cam assemblies 160 to counter-rotate synchronously. Left and right power cables 191, 192 are operatively coupled respectively between the left and right limbs 150 and the left and right cam assemblies 160. A bowstring 196 is operatively coupled to the left and right cam assemblies 160.

The cam assemblies 160, the synchronizing cable 194, the power cables 191, 192, and the left and right limbs 150 are configured to cooperate to apply a respective selected tension to the bowstring 196 at all respective points along the bowstring 196 path of travel.

The left and right limbs 150 extend laterally from locations rearward from the front end of the stock 110. According to an embodiment, the stock 110 has a length L between the front end and the back end; and the left and right limbs 150 extend from locations at least 25% of L rearward from the front end of the stock 110. For example, the left and right limbs 150 extend from locations about half way (L/2) between the front end and the back end of the stock 110. As depicted in the FIGS. 1B, 2A and 2B, the left and right limbs 150 can extend from locations greater than 50% of L rearward from the front end of the stock 110.

When the bowstring 196 is pulled rearward to cock the crossbow, the power cables 191, 192 pull the limbs 150 toward the front end of the stock 110. The power cables 191, 192 each preferably remain within a 30 degree angle of parallel to the long axis of the stock 110 throughout the range of the bowstring pull. According to an embodiment, the power cables 191, 192 each remain within a 15 degree angle of parallel to the long axis of the stock 110 throughout the range of the bowstring pull. According to an embodiment, the power cables 191, 192 each remain within a 5 degree angle of parallel to the long axis of the stock 110 throughout the range of the bowstring pull. According to embodiments, each of the power cables 191, 192 remains at an equal and opposite angle to the stock 110 compared to the other power cable, to precision within 1 degree of angle.

The synchronizing cable 194 can be disposed on wheels below the bottom of the stock 110, the synchronizing cable wheels being coupled to axles 169 of the left and right cam assemblies 160 to rotate synchronously with other portions of the cam assemblies.

The top surface of the stock 110 may define an arrow groove 112 configured to hold an arrow before release of the bowstring 196. The arrow groove 112 is formed coincident with the longitudinal axis of the stock 110 on or adjacent to the top surface of the stock. In an embodiment, the left and right limbs 150 join to the stock 110 sufficiently far below the top surface of the stock 110 and the arrow groove 112 to prevent vanes of the arrow (not shown) from contacting the limbs 150 during propulsion of the arrow (i.e., release of the bowstring). Similarly, the rigid cam support structure 140 may be positioned below the top surface of the stock 110 sufficiently to prevent vanes of the arrow from contacting the rigid cam support structure 140 during propulsion of the arrow.

In one embodiment, the rigid cam support structure 140 supports the axles 169 of the left and right cam assemblies 160 forward of the front end of the stock 110. In another embodiment, the rigid cam support structure 140 supports the axles of the left and right cam assemblies 160 at locations perpendicular to the front end of the stock 110. In another embodiment, the rigid cam support structure supports the axles of the left and right cam assemblies 160 at locations perpendicular to and within the length of the stock assembly 110, such as one to two inches rearward of the front end of the stock 110.

In an embodiment, the rigid cam support structure 140 is formed integrally with the stock 110.

The resilient limb 150 on either side of the stock 110 may be half of a single limb passing between the stock and strut, which can double as a fastener (as shown), or may be an individual piece mounted on either side, for example on a plate attached to the side of the strut and stock.

The cam units 160, which can alternatively be referred to as "cam/wheel units," "cam assemblies," "cam/wheel assemblies," and the like, need not be integral in the sense that they are made from a single piece of material, or are otherwise inseparable into parts, or have no parts; they can be integrally constructed, for example with different planar cams or wheels riveted, welded, adhered, or otherwise fastened together, but such assemblies are referred to in the claims as "cam/wheel units." Assemblies are suitable for the invention if they are rigid enough to act as a unit, or as one piece.

The phrase "cam/wheel" is redundant in the sense that a "wheel" is merely a circular "cam," and thus "cam" is broader than "wheel." Here, "wheel" means a cam having a substantially circular shape and/or a constant radius through at least some angle around the axis of the cam. The phrase "cam/wheel," though redundant, is used for clarity.

Above, and in the following claims, "substantially" means a factor of 0.9; 0.99; 0.999; and so on.

It will be understood that gravitational terms such as "lower," "above" are used for convenience and refer to the usual shooting position for a crossbow. They do not limit the crossbow to any orientation.

In the following claims, "limb" covers any arm- or leg-like extension such as the traditional bow, but also covers other devices for storing mechanical potential energy, including but not limited to coil springs, compressible gases, elastomers, etc. that lie at least partially outside the stock on the left or right. For example, the traditional elastic bow can be modified to include an elastic tensile member (coil spring, elastic cable, etc.) and a more-rigid arm (limb).

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A crossbow, comprising:

a stock assembly defining an arrow track configured to be in contact with an arrow prior to release, the stock assembly having a front end and a back end, the stock assembly being characterized by a length L between the front end and back end;

left and right flexible limbs extending laterally from the stock assembly respectively to a left limb tip and a right limb tip;

a left cam assembly and a mirror-image right cam assembly, each cam assembly being rotatably mounted on a respective end of a rigid cam support structure; each one of the left and right cam assemblies further including a respective bowstring cam, a synchronizing wheel, and a power cable cam;

the rigid cam support structure disposed adjacent and perpendicular to the front end of the stock assembly and fixed rigidly thereto, the cam support structure being disposed in a plane defined by the stock assembly and the first and second limbs or in a plane parallel thereto and extending left and right from the centerline of the stock;

a left bearing and a right bearing disposed in the cam support structure, configured to rotatably support the left and right cam assemblies on respective fixed axes of rotation;

a left limb cable and a right limb cable attached, respectively to the left limb tip and the right limb tip without any intervening wheel or cam;

wherein the left limb cable is attached to the left limb-cable cam, and the right limb cable is attached to the right limb-cable cam;

a synchronizing cable disposed between the left synchronizing wheel and the right synchronizing wheel, and configured to cross itself in a central medial portion; and a bowstring extending between the left bowstring cam or wheel and the right bowstring cam or wheel, and being anchored to both;

wherein the bowstring, limb cables, and synchronizing cable are arranged so as to exert force only on an outer circumferential portion of any cam or wheel;

wherein the synchronizing cable extends freely in space between the left and right cam/wheel units; and wherein force is exerted between any cable or string and any other cable or string only by way of axial torque exerted by the cam/wheel units.

2. The crossbow of claim 1, wherein each cam unit comprises a limb-cable track, a bowstring track and a synchronizer track, the tracks being separate from each other and disposed along an outside circumference of each respective cam or wheel.

3. The crossbow of claim 2, wherein each cam or wheel further comprises an anchor point configured to anchor the limb cable, the synchronizer, or the bowstring.

4. The crossbow of claim 1, wherein the left limb cable and the right limb cable are pivotally attached respectively to the left limb tip and the right limb tip.

5. The crossbow of claim 1, wherein the left limb cable and the right limb cable are non-pivotally attached respectively to the left limb tip and the right limb tip.

6. The crossbow of claim 1, wherein the left cam/wheel unit and the right cam/wheel unit are the only parts of the crossbow that rotate on a fixed axis relative to the stock, except for parts of a trigger mechanism.

7. The crossbow of claim 1, wherein for each cam/wheel unit, the bowstring and the limb cable are wrapped around the cam/wheel units in opposite rotations to one another.

8. The crossbow of claim 1, wherein no tensile member is attached to any interior point inside of any circumferential point of any or wheel unit, except after passing over a circumference to an interior anchor point.

9. The crossbow of claim 1, wherein the at least one flexible limb is attached to the crossbow at least partly rearward from a halfway point L/2 along the stock length L.

10. A compound crossbow, comprising:

a stock assembly having a front end, a back end, and left, right, top, and bottom sides;

left and right flexible limbs extending laterally respectively from the left and right sides of the stock assembly to respective left and right limb tips, with a left limb cable and a right limb cable attached, respectively to the left limb tip and the right limb tip without any intervening wheel or cam;

a rigid cam support structure disposed at or near the front end of the stock assembly;

left and right cam assemblies rotationally coupled to the rigid cam support structure on axles such that rotational axes of the left and right cam assemblies are fixed relative to the stock assembly, each one of the left and right cam assemblies further including a respective bowstring cam, a synchronizing wheel, and a power cable cam;

a synchronizing cable operatively coupled to the left and right cam assemblies to cause the left and right cam assemblies to counter rotate synchronously;

left and right power cables operatively coupled respectively between the left and right limbs and the left and right cam assemblies; and a bowstring operatively coupled to the left and right cam assemblies;

wherein the bowstring, left and right limb cables, and synchronizing cable are arranged so as to exert force only on an outer circumferential portion of any cam or wheel; and wherein force is exerted between any cable or string and any other cable or string only by way of axial torque exerted by the cam/wheel units.

11. The compound crossbow of claim 10, wherein the cam assemblies, the synchronizing cable, and the power cables are configured to cooperate to apply a respective selected tension to the bowstring at all respective points along a bowstring path of travel.

12. The compound crossbow of claim 10, wherein the left and right limbs extend laterally from locations rearward from the front end of the stock.

13. The compound crossbow of claim 10, wherein the stock has a length L between the front end and the back end; and wherein the left and right limbs extend from locations at least 25% of L rearward from the front end of the stock.

14. The compound crossbow of claim 13, wherein the left and right limbs extend from locations about half way L/2 between the front end and the back end of the stock.

15. The compound crossbow of claim 14, wherein the left and right limbs extend from locations greater than 50% of L rearward from the front end of the stock.

16. The compound crossbow of claim 10, wherein the power cables pull the limb tips in a forward direction relative to the stock when the bowstring is pulled rearward.

17. The compound crossbow of claim 10, wherein the synchronizing cable is disposed on pulleys below the bottom of the stock, the pulleys being coupled to axles of the left and right cam assemblies.

18. The compound crossbow of claim 10, wherein the top surface of the stock defines an arrow groove configured to hold an arrow before release of the bowstring.

19. The compound crossbow of claim 10, wherein the left and right limbs join to the stock sufficiently far below the top surface of the stock to prevent vanes of the arrow from contacting the limbs during propulsion of the arrow.

20. The compound crossbow of claim 10, wherein the rigid cam support structure is positioned below the top surface of the stock sufficiently to prevent vanes of the arrow from contacting the rigid cam support structure during propulsion of the arrow.

21. The compound crossbow of claim 10, wherein the rigid cam support structure supports the axles of the left and right cam assemblies forward of the front end of the stock.

22. The compound crossbow of claim 10, wherein the rigid cam support structure supports the rotational axes of the left and right cam assemblies at locations perpendicular to the front end of the stock.

23. The compound crossbow of claim 10, wherein the rigid cam support structure is formed integrally with the stock.

* * * * *